United States Patent [19]

Abbott et al.

[11] 4,018,187

[45] Apr. 19, 1977

[54] GROOVED MAGNETIC BRUSH ROLL

[75] Inventors: Jerry Joe Abbott, Longmont; Allison Holland Caudill, Lafayette, both of Colo.

[73] Assignee: International Business Machines Corporation, Armonk, N.Y.

[22] Filed: June 30, 1976

[21] Appl. No.: 701,251

[52] U.S. Cl. ..... 118/658; 427/18

[51] Int. Cl.[2] ..... G03G 15/08

[58] Field of Search ..... 118/637, DIG. 23; 355/3 DD; 427/18, 19, 21

[56] References Cited

UNITED STATES PATENTS

| | | | |
|---|---|---|---|
| 2,811,465 | 10/1957 | Greig | 427/19 |
| 3,283,703 | 11/1966 | Childress et al. | 118/637 |
| 3,674,532 | 7/1972 | Morse | 427/18 |
| 3,830,199 | 8/1974 | Saito et al. | 118/637 |
| 3,905,332 | 9/1975 | Sawada et al. | 118/DIG. 23 |
| 3,906,896 | 9/1975 | Stansell | 118/637 |
| 3,939,801 | 2/1976 | Tanaka et al. | 118/637 |
| 3,941,084 | 3/1976 | Karita | 427/21 |
| 3,978,817 | 9/1976 | Hauser et al. | 118/637 |

*Primary Examiner*—Henry S. Jaudon
*Attorney, Agent, or Firm*—Charles E. Rohrer

[57] ABSTRACT

For use in an electrophotographic copy machine utilizing magnetic brush roll development, an improved hollow magnetic roll made of non-magnetic material containing axially located grooves along the exterior periphery. The grooves are spaced in a range from 15–25 times the diameter of the permeable carrier beads used in the development process and the lands between grooves are polished to a high degree, e.g., 25 $\mu$ inches. The depth of the grooves is to a minimum of 1–2 times bead diameter while the groove width is to a minimum of 2–3 times bead diameter.

7 Claims, 3 Drawing Figures

GROOVED MAGNETIC BRUSH ROLL

GROOVED MAGNETIC BRUSH ROLL

This invention relates to a magnetic brush roll for use in an electrophotographic copier machine and more particularly to a roll with a plurality of axially located grooves.

PATENTS INCORPORATED BY REFERENCE

This disclosure includes the descriptive matter of U.S. Pat. No. 3,863,603 and U.S. Pat. No. 3,999,514; both of which are specifically incorporated by reference herein. With regard to U.S. Pat. No. 3,863,603; the instant invention replaces the particular roll shown in FIG. 2 thereof, and with respect to U.S. Pat. No. 3,999,514; the instant invention provides the desired surface for roll 14 shown in FIGS. 1, 2 and 3 thereof.

BACKGROUND OF THE INVENTION

In typical electrophotographic copier machines, a latent image is produced on a photoconductive surface; toner, typically a black substance, is spread onto the latent image and is attracted to that part of the image which carries a charge, e.g., an image of typewritten lines while being unattracted to discharged areas, e.g., the white sheet of paper. A copy sheet (in plain paper copiers) is then placed in juxtaposition with the toner image and receives a transfer of toner which is then heated and bonded to the copy paper forming the finished copy.

In the above machine, toner is brought to the latent image at the development zone by various methods, including the deposit of toner on small carrier beads made of magnetic material. Toner is attracted to the carrier beads by a triboelectric effect between a thin polymeric coating on the magnetic beads and the toner itself. When the carrier is brought to the development zone, the beads are crushed together with a jarring effect sufficient to overcome the triboelectric effect and release the toner for attraction to the charged part of the latent image.

In magnetic brush developer units wherein the carrier particles are moved from a pickup zone near the bottom of the rotation of the magnetic brush roll and moved upwardly to a development zone, it is necessary to provide the surface of the magnetic brush roll with a sufficiently roughened exterior in order to mechanically seat the spherically-shaped carrier beads as the magnetic forces produced by the magnetic brush roll hold the beads to the exterior surface while the beads are carried upwardly. If the exterior surface of the roll does not provide a sufficient seating surface for holding the beads in place, poor copy quality will result from insufficient developer flow, i.e., spotty copy.

On the other hand, if the exterior surface of the roll is inordinately rough, the spherically-shaped carrier beads will be too tightly mechanically locked in place and will not be able to tumble and roll on one another in the development zone where they are brought into contact with the latent image. Such a condition will also provide poor copy quality and has the further detrimental effect of wearing the surface of the carrier when the carrier beads are crushed together without the ability to tumble and move. Since the surface of the carrier is coated with a polymeric material to provide a triboelectric effect between the carrier and the toner, the polymeric coating is degraded by such action. A further detrimental effect occurs in that the toner material is ground against the surface of the magnetic brush roll where, after a period of use, it forms a toner film along the surface of the roll. This condition is especially true of toners with low temperature melting points of the types required with a hot roll fuser. The result is an erratic and unpredictable magnetic brush roll bias voltage which should be stable for minimal copy background and for copy density control.

It is, therefore, an object of this invention to provide a magnetic brush developer roll surface which provides an adequate mechanical interlock with the carrier beads to move the beads with adequate flow to the development area.

It is a further object of this invention to provide a surface for a magnetic brush roll which allows adequate tumbling and movement of the beads relative to each other and to the roll surface when the development zone is reached.

SUMMARY OF THE INVENTION

This invention provides a hollow magnetic brush roll with axially located grooves spaced apart by 15–25 times carrier bead diameter. Additionally, the land surfaces between the grooves are polished such that the surface roughness in the longitudinal direction is less than 25 $\mu$inches. The groove depth is a minimum of 1–2 times the diameter of the carrier beads, while the groove width is a minimum of 2–3 times the diameter of the carrier beads. The roll is typically made of nonmagnetic material, such as aluminum. In operation, carrier beads are picked up and held against the roll surface by magnetic forces and are mechanically seated by the frictional forces supplied by the grooves. In that manner, layers of beads are carried upwardly by the roll to the development station.

BRIEF DESCRIPTION OF THE DRAWINGS

The above mentioned and other features and objects of this invention and the manner of attaining them will become more apparent and the invention itself will best be understood by reference to the following description of embodiments of the invention taken in conjunction with the accompanying drawings, the description of which follows.

DETAILED DESCRIPTION

Figure 1:
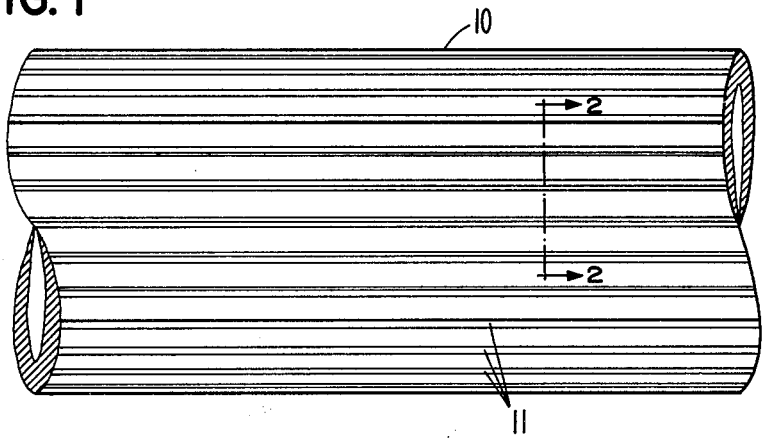
FIG. 1 shows the roll of this invention with grooves axially located along the periphery of the roll.
Figure 2:
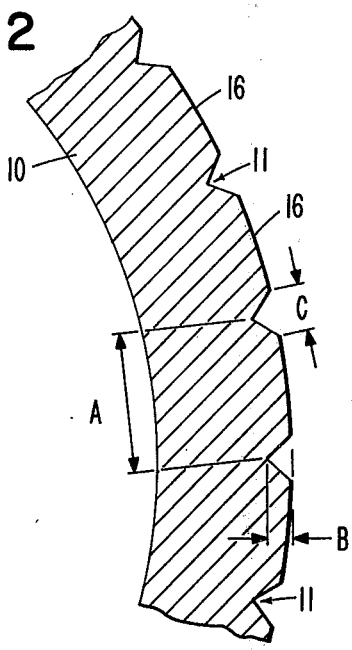
FIG. 2 shows a portion of the roll in cross section with the various dimensions.

FIG. 1 shows a view of the grooved roll of this invention, while FIG. 2 shows a cross section of the roll showing the shape of the groove in the exterior periphery. While a V-shaped groove is shown in FIG. 2, the particular cross-sectional shape of the groove is not pertinent to the invention. FIG. 2 shows the critical dimension A, which according to the inventive concept herein, must lie in a range of 15–25 times the diameter of the carrier bead used in the development process. Dimension B, the depth of the groove, is not critical but should be a minimum of 1–2 bead diameters so that sufficient mechanical interlocking forces from carrier bead to carrier bead can be provided. Dimension C shows the width of the groove and again, that dimension is not critical; preferably, however, dimension C should be a minimum of 2–3 times bead diameter.

Figure 3:
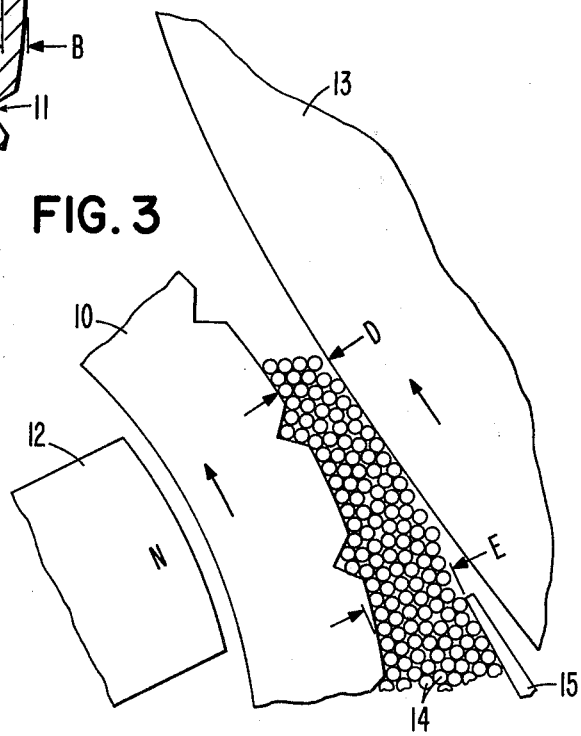
FIG. 3 shows an enlarged diagrammatic view of carrier beads being carried by the grooved roll into a development zone at which the carrier deposits toner upon a latent image.

FIG. 3 shows a diagrammatic view of carrier beads being carried by the magnetic brush roll 10 to a developing area generally shown by the dimension D. The development area is located at the nip between the magnetic brush roll 10 and the photoconductor 13, which in this instance, is carried on a drum. A magnetic force to hold the carrier beads to the magnetic brush roll 10 is provided by magnets such as shown at 12. The carrier beads 14 are shown held against the magnetic brush roll 10 and are shown entering the nip at a thickness produced by a doctoring blade 15. In a typical electrophotographic machine, doctoring blade 15 would produce a height of about 0.09 inches of 0.012 diameter carrier beads which enter a nip, dimension B, of about 0.05 inches. Consequently, as the carrier is forced through the nip, there is a tumbling and a moving together of the carrier beads in order to pass through the smaller space provided thereat. That tumbling and moving together produces the mechanical forces which jar toner loose from the carrier and cause it to deposit on the latent electrostatic image carried by the photoconductor 13, thus providing development powder to that image. Typical carrier bead diameters range from 400 microns to 100 microns and therefore the diagrammatic view of FIG. 3 does not accurately express the real dimensions of the carrier beads involved which appear, in FIG. 3, to be larger than they actually are. However, the concept of grooves for providing a semi-locking frictional force to the beads as they are carried to the development area is illustrated by FIG. 3.

The land areas 16 between grooves are highly polished in order to provide a surface against which there is little or no abrasive effect causing toner to deposit itself on the development roll surface during the tumbling at the development zone. However, it has been found that if the grooves are too closely spaced together, the mechanical interlocking forces on the beads become great enough so that the beads are held in too tight a compacted form in passing through the development zone, with the result that toner is ground into the surface of the development roll.

On the other hand, if the grooves are too widely spaced, mechanical interlocking forces holding the beads in place are insufficient with the consequent effect that the desired height of 0.09 inches in entering the nip is not uniform. It has been found that if the grooves are spaced between 15 and 25 times the carrier bead diameter, proper resolution of all variables is obtained.

While the principles of the invention have been described in connection with specific apparatus, it is to be clearly understood that this description is made only by way of example and not as a limitation to the scope of the invention as set forth in the objects thereof and in the accompanying claims.

What is claimed is:

1. A magnetic brush developer wherein a developer material comprising a toner coated magnetic carrier is supplied to a rotating magnetic brush roll to be conveyed by said roll to an elevated development zone, said roll comprising:

a rotatably mounted hollow roll;

magnetic means disposed within said hollow roll for creating a magnetic field in the path of the periphery of said roll;

means to bring said developer material into contact with the roll surface;

said roll surface containing axially located grooves spaced apart in a range from 15–25 times the diameter of said carrier.

2. The developer of claim 1 wherein said grooves are of a minimum width of 2–3 times the diameter of said carrier.

3. The developer of claim 2 wherein said grooves are of a minimum depth of 1–2 times the diameter of said carrier.

4. The developer of claim 1 wherein said roll is cylindrical in shape with polished land surfaces between grooves to provide a smooth surface for supporting said developer material between grooves.

5. The developer of claim 4 wherein said hollow roll is electrically conductive throughout its entirety.

6. The developer of claim 5 wherein said grooves are of a minimum width of 2–3 times the diameter of said carrier.

7. The developer of claim 6 wherein said grooves are of a minimum depth of 1–2 times the diameter of said carrier.

* * * * *